US008939053B2

(12) United States Patent
Pardue

(10) Patent No.: US 8,939,053 B2
(45) Date of Patent: Jan. 27, 2015

(54) ASSISTED OPENING MECHANISM FOR A FOLDING KNIFE

(76) Inventor: Joseph R. Pardue, Hillister, TX (US)

( * ) Notice: Subject to any disclaimer, the term of this patent is extended or adjusted under 35 U.S.C. 154(b) by 315 days.

(21) Appl. No.: 13/595,212

(22) Filed: Aug. 27, 2012

(65) Prior Publication Data

US 2014/0053409 A1 Feb. 27, 2014

(51) Int. Cl.
*B26B 3/06* (2006.01)

(52) U.S. Cl.
USPC ..... 83/13; 30/159; 30/160

(58) Field of Classification Search
USPC ..... 83/13; 30/155, 161, 159, 160
See application file for complete search history.

(56) References Cited

U.S. PATENT DOCUMENTS

| | | | | | |
|---|---|---|---|---|---|
| 199,766 | A * | 1/1878 | Whitehouse | ..... | 30/159 |
| 273,858 | A * | 3/1883 | Korn | ..... | 30/159 |
| 306,839 | A * | 10/1884 | Korn | ..... | 30/159 |
| 401,093 | A * | 4/1889 | Wilzin | ..... | 30/159 |
| 551,052 | A * | 12/1895 | Shonnard | ..... | 30/159 |
| 6,145,202 | A * | 11/2000 | Onion | ..... | 30/160 |
| 6,338,431 | B1 * | 1/2002 | Onion | ..... | 30/161 |
| 7,146,736 | B1 | 12/2006 | Collins | | |
| 7,676,932 | B2 * | 3/2010 | Grice et al. | ..... | 30/160 |
| RE41,259 | E * | 4/2010 | McHenry et al. | ..... | 30/161 |
| 7,698,821 | B2 | 4/2010 | Ralph | | |
| 7,854,067 | B2 * | 12/2010 | Lake | ..... | 30/159 |
| 8,020,302 | B2 * | 9/2011 | Kao | ..... | 30/155 |
| RE42,906 | E * | 11/2011 | Onion | ..... | 30/160 |
| 8,161,653 | B2 * | 4/2012 | Nenadic | ..... | 30/161 |
| 2005/0097754 | A1 * | 5/2005 | Onion | ..... | 30/159 |
| 2006/0168819 | A1 * | 8/2006 | Perreault | ..... | 30/161 |
| 2007/0068002 | A1 * | 3/2007 | Onion | ..... | 30/161 |
| 2007/0169351 | A1 * | 7/2007 | Steigerwalt | ..... | 30/155 |
| 2009/0217533 | A1 * | 9/2009 | Kao | ..... | 30/159 |
| 2011/0203115 | A1 | 8/2011 | Onion | | |
| 2012/0304470 | A1 * | 12/2012 | Freeman | ..... | 30/159 |
| 2013/0067750 | A1 * | 3/2013 | Kao | ..... | 30/159 |

* cited by examiner

*Primary Examiner* — Sean Michalski
(74) *Attorney, Agent, or Firm* — R. Tracy Crump

(57) ABSTRACT

An assisted opening mechanism for folding knives, which helps hold the blade in the closed position, as well as, assists in moving the blade toward the open position. The mechanism includes a bar spring seated within one of the handle sides and a contact pin extending from the blade. The bar spring is seated within a recessed cavity formed on one side of the knife handle and engages the contact pin, which extends outward from one side of the blade through an arcuate slot in the handle side.

7 Claims, 7 Drawing Sheets

ASSISTED OPENING MECHANISM FOR A FOLDING KNIFE

BACKGROUND AND SUMMARY OF THE INVENTION

This invention relates to folding knives and in particular an assisted opening mechanism for folding knives.

Assisted opening mechanisms are popular features for folding knives due to their added utility and their improved safety and reliability over automatic or "switch-blade" type opening mechanisms. Folding knives typically include a blade pivotally connected to a handle, which allows the blade to rotate relative to the handle between an open position in which the blade extends from the handle and a closed position in which the blade is received within a corresponding recess within the handle. Assisted opening mechanisms typically include a bias member which moves the blade toward the open position when the blade is manually rotated from the closed position beyond a certain threshold point. Often times, the mechanism also applies a reverse bias in the closed position to hold the blade closed. Examples of the folding knives having assisted opening mechanisms may be found in U.S. Pat. No. 6,145,202; 6,338,431.

The present invention seeks to provide an improved assisted opening mechanism for folding knives, which helps hold the blade in the closed position, as well as, assists in moving the blade toward the open position. The assisted opening mechanism of this invention includes a bar spring seated within one of the handle sides and a contact pin extending from the blade. The bar spring is seated within a recessed cavity formed on one side of the knife handle. The contact pin extends outward from one side of the blade through an arcuate slot in the handle side and is position radially from the pivot axis of the blade so that the contact pin travels along the length of the acruate slot as the blade moves between its open and closed position. The contact pin rotates into engagement with the bar spring as the blade moves between the open position and the closed position, whereby the bar spring exerts a bias on the blade, which assists in moving the blade to the open position.

The assisted opening mechanism of this invention can be readily incorporated into folding knives of any conventional style, design or configuration, such as frame lock folders and liner lock folders and adds only two additional components to the basic folding knife design. The bar spring is completely enclosed and protected within one side of the knife handle. The bar spring only engages the contact pin and causes no material wear on the blade itself. The bar spring exerts no force on the blade when the blade is in the open position, but assists in holding the blade in the closed position until opening is manually initiated; consequently, the assisted opening mechanism does not affect the 'lock-up" of the blade in the open position or the closed position.

The above described features and advantages, as well as others, will become more readily apparent to those of ordinary skill in the art by reference to the following detailed description and accompanying drawings.

BRIEF DESCRIPTION OF THE DRAWINGS

The present invention may take form in various system and method components and arrangement of system and method components. The drawings are only for purposes of illustrating exemplary embodiments and are not to be construed as limiting the invention. The drawings illustrate the present invention, in which.

DESCRIPTION OF THE PREFERRED EMBODIMENT

Figure 1:
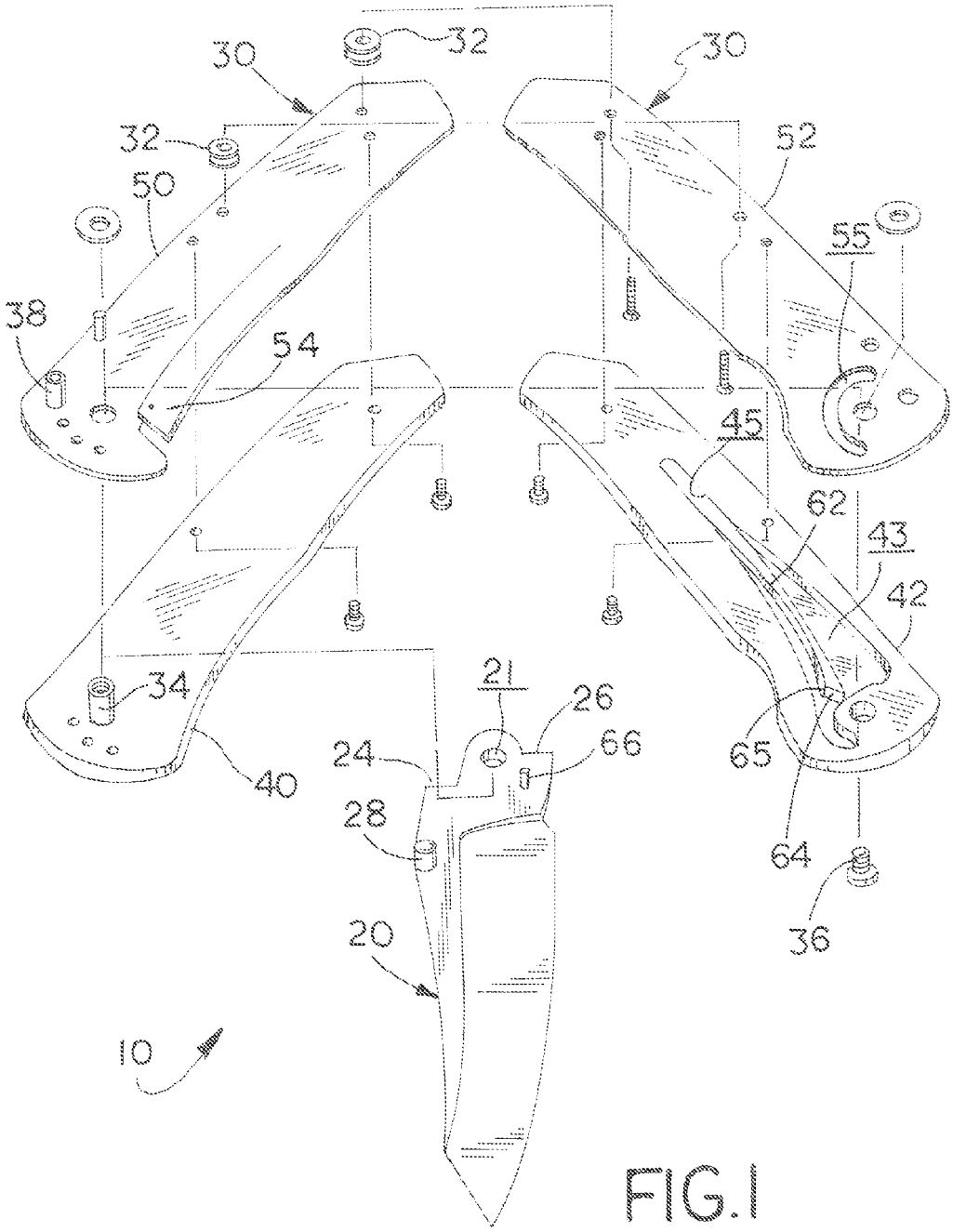
FIG. 1 is a partial exploded view of an embodiment of the knife of this invention.
Figure 2:
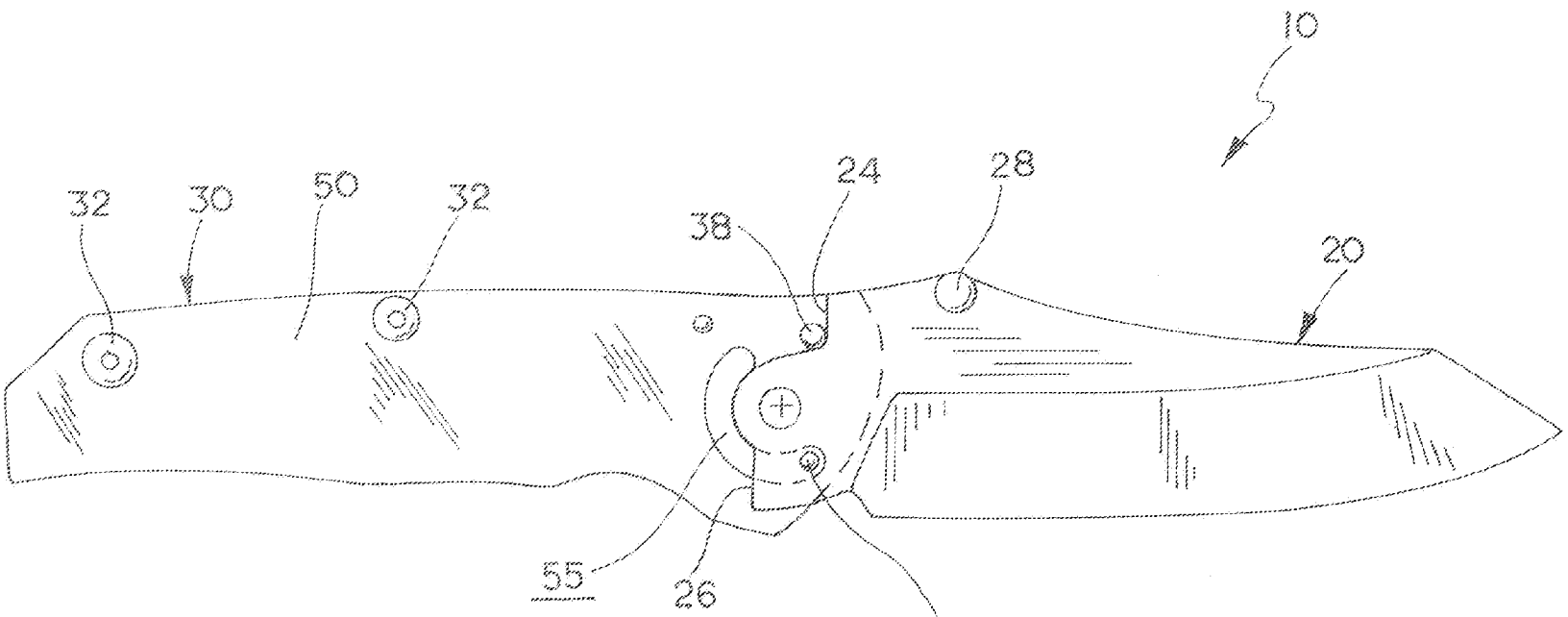
FIG. 2 is a side sectional view of the knife of FIG. 1 in the open position to show the blade relative to the left side liner.
Figure 3:
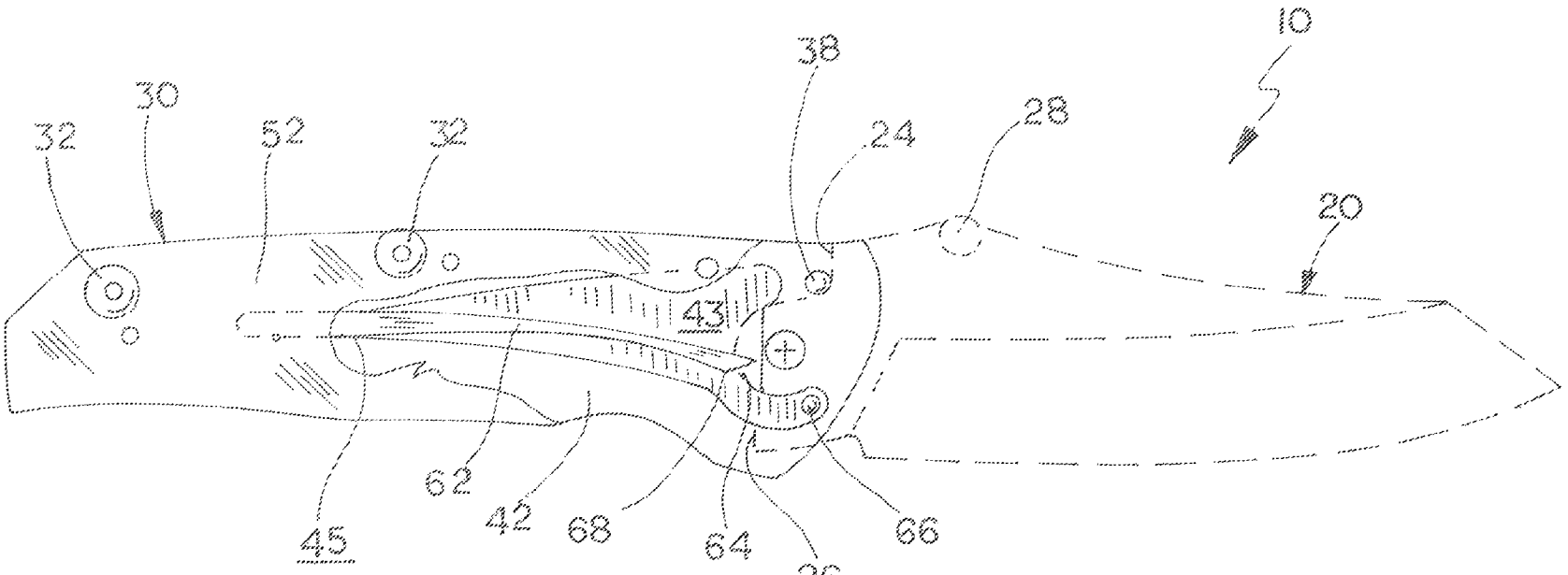
FIG. 3 is a side sectional view of the knife of FIG. 1 in the open position with a portion of the left side liner cut away to show the blade relative to the left side scale.
Figure 4:
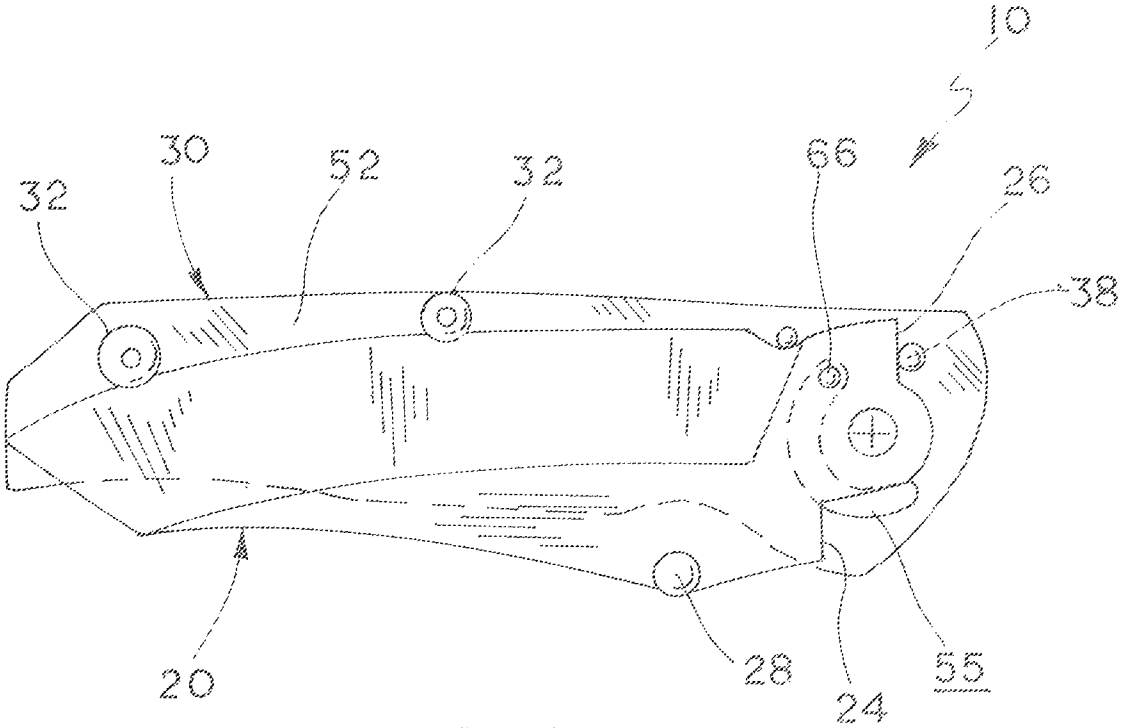
FIG. 4 is a side sectional view of the knife of FIG. 1 in the closed position to show the blade relative to the left side liner.
Figure 5:
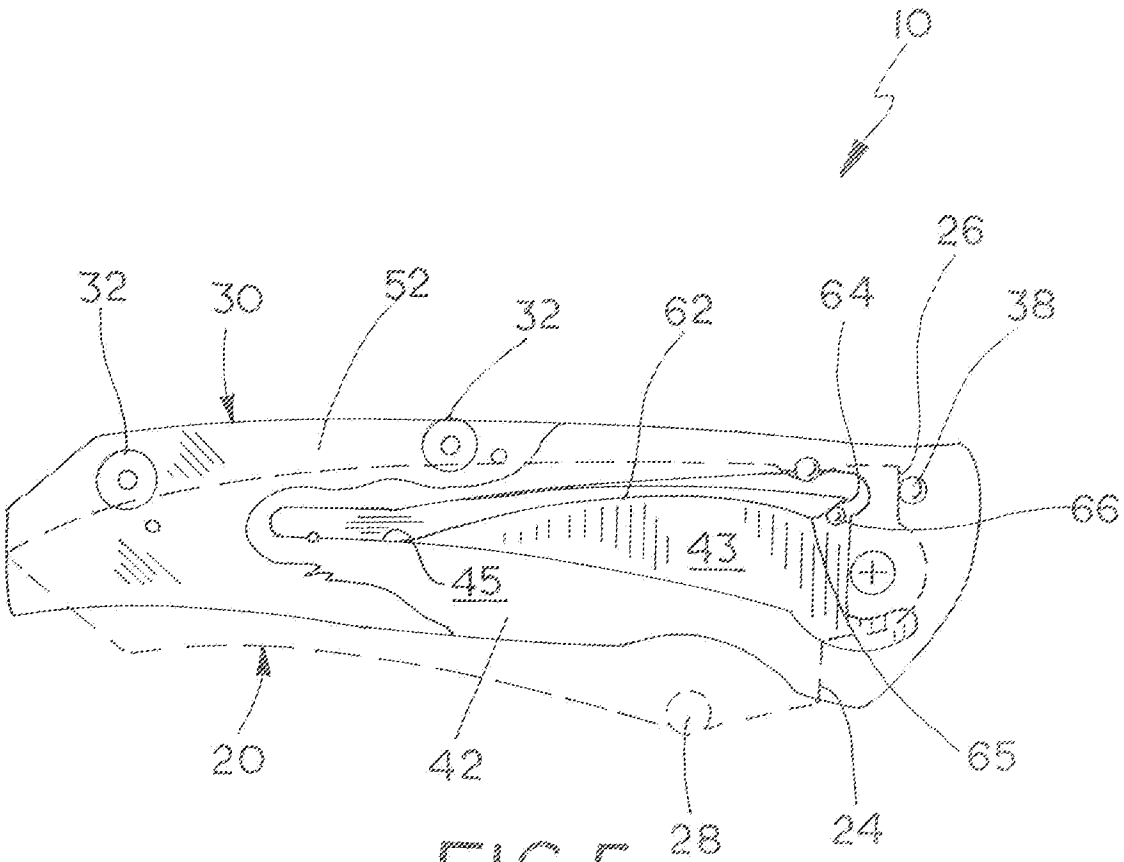
FIG. 5 is a side view of the knife of FIG. 1 in the closed position with a portion of the left side liner cut-away to show the blade relative to the left side scale.
Figure 6:
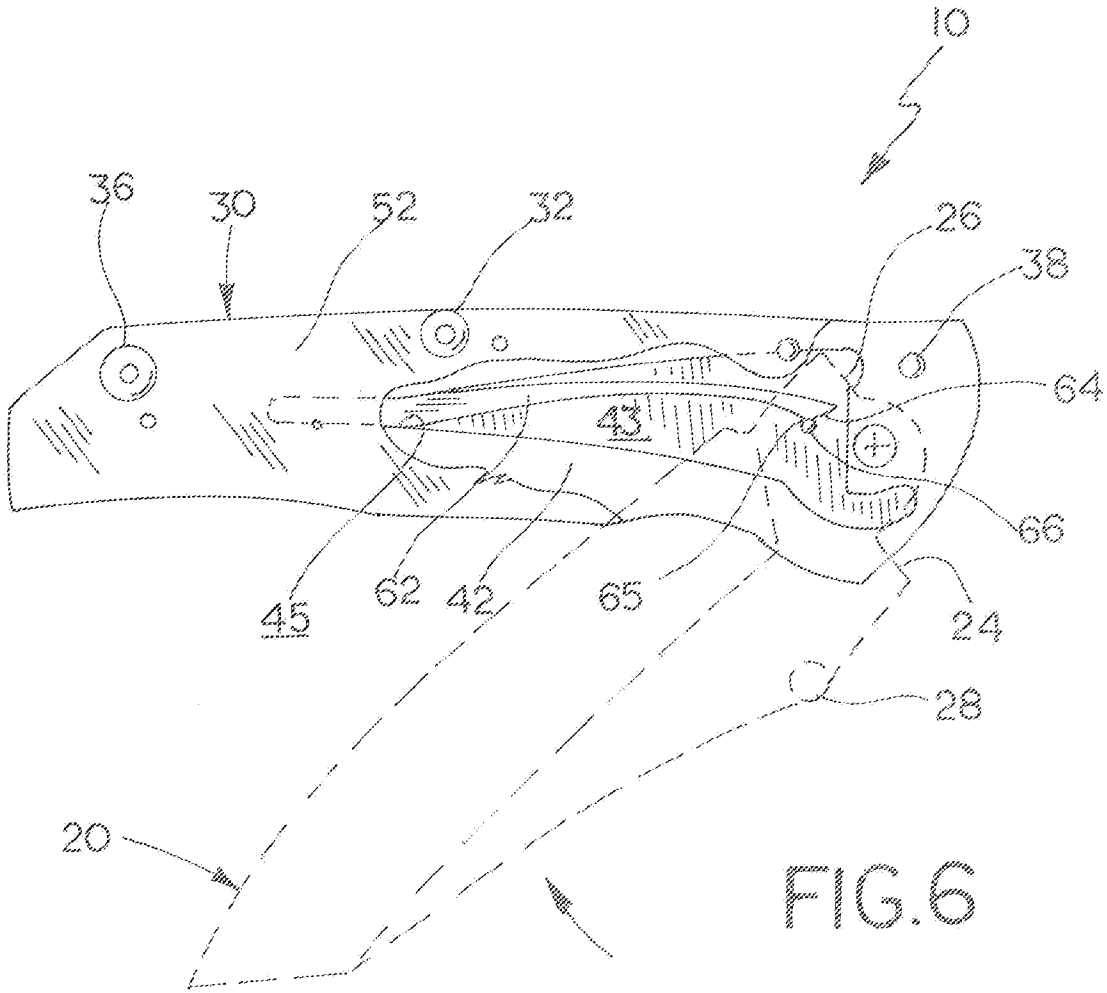
FIG. 6 is a side view of the knife of FIG. 1 in a partially open position with the right side scale and liner removed and with a portion the left side liner cut-away to show the blade relative to the left side scale.
Figure 7:
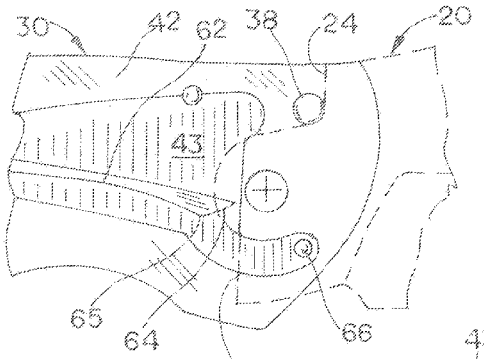
FIG. 7 is a partial side sectional view of the knife of FIG. 1 in the open position to show the bias spring relative to the blade.
Figure 8:
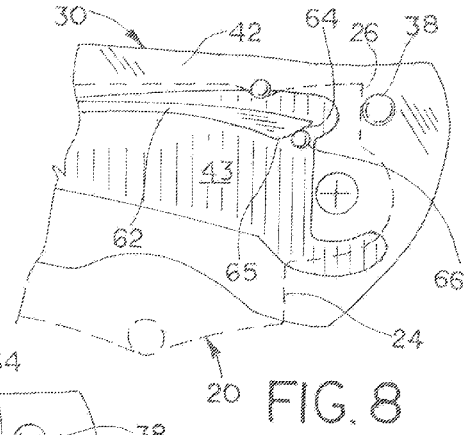
FIG. 8 is a partial side sectional view of the knife of FIG. 1 in the closed position to show the bias spring relative to the blade.
Figure 9:
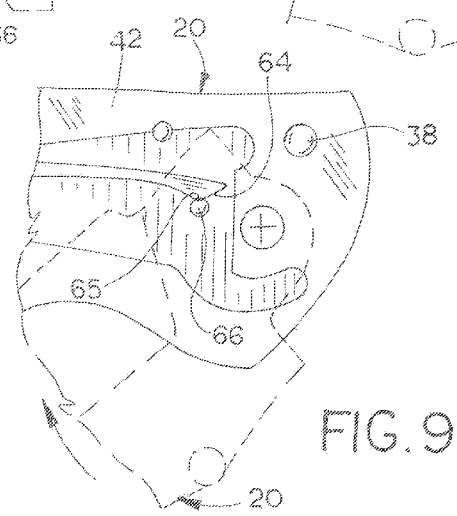
FIG. 9 is a partial side sectional view of the knife of FIG. 1 in a partially open position to show the bias spring relative to the blade.

Referring now to the drawings, FIGS. 1-9 illustrate an embodiment of a folding knife 10, which incorporates the assisted opening mechanism 60 of this invention. Knife 10 includes a blade 20 pivotally coupled to a handle 30 for rotation between an open position (FIGS. 2, 3, and 7) and a closed position (FIGS. 4,5 and 8). Knife 10 is a liner lock style folding knife, although, other styles of folding knives, including but not limited to "lock-back" and "frame-lock" style knives may be modified within the teachings of the present invention to incorporate the assisted opening mechanism 20. For ease of explanation, many commonly known features of folding knives are omitted in the figures and description of embodiments of the invention. For example, fasteners, such as machine screws, bolts, rivets, pins, washers, etc. are well known in the art and need not be discussed in detail. Other features are described to provide context for the embodiment described, but are not essential to the invention or particular embodiment described and are not to be construed as being essential to the claimed embodiment unless so indicated.

As shown, blade 20 uses a conventional single edge design common in folding knives having a tang 22 with a pivot bore 21. Blade 20 is typically constructed from metals or other material suitable for use in cutting blades and may be ground in any desired blade configuration. Blade 20 has two contact surfaces 24 and 26 formed adjacent tang 22. Blade 20 also includes a thumb stud 28 pressed into a bore or otherwise affixed or machined into the blade's flat or spine.

Handle 30 consists of a pair of side members that are spaced apart to form an area 31 for receiving blade 20 therein in the closed position. Each handle side member (left and right sides) includes outer scale 40, 42 and inner liner 50, 52. Scales 40, 42 may be constructed of any material including metal, plastic and nylon composite material, such as nylon Micarta, G10. Liners 50 and 52 are stamped or cut from sheets of metal, such as aluminim, steel or titanium. Back spacers 32 positioned between liners 50, 52 space the liners apart to form blade receiving area 31.

Blade 20 is pivotally connected to handle 30 by a two piece pivot (pivot barrel 34 and lock screw 36). Blade 20 pivots axially about pivot barrel 34, which extends through a pivot bore 21 in blade 20. Pivot barrel 34 extends through a bore in one handle side (right) and is secured by lock screw 36, which threads into the pivot barrel through a bore in the opposite handle side (left). A stop pin 38 extends between liners 50, 52 at the proximal end of handle 30 to provide a surface against which the contact surface 24 of blade 20 abuts when the blade is in the open position and against contact surface 26 when the blade is in the closed position. Right liner 52 is configured to have a liner lock portion 54 portion, which locks the blade in the open position in a known manner.

Assisted-opening mechanism 60 includes a bar spring 62 seated within one of the handle sides and a contact pin 66 extending from blade 20. Bar spring 62 is an elongated piece of metal or other suitable material, typically a spring steel. Bar spring 62 is seated within a generally triangular shaped recessed cavity 43 formed in scale 42 and covered by liner 52. The distal end of bar spring 62 is restrictively seated with an elongated slot 45 formed at the lone distal point of recessed cavity 43. The proximal end of bar spring 60 terminates in an angled contact face 64, which extends into the open area of recessed cavity 43. Contact pin 66 extends outward from one side of blade 20 through an arcuate slot 55 in liner 52 and into cavity 43 in scale 42. Contact pin 66 is position radially from the pivot axis of pivot barrel 34 so that contact pin 66 travels along the length of slot 55 as blade 20 moves between its open and closed position.

As shown in FIGS. 2-9, contact pin 66 rotates into engagement with angled face 64 of bar spring 62 as blade 20 moves between the open position and the closed position whereby bar spring 62 exerts a rotational force on blade 20, which helps hold the blade in the closed position, as well as, assists in moving the blade toward the open position. In the open position (FIGS. 2, 3 and 7), contact pin 66 is spaced from bar spring 62 at the end of arcuate slot 55 and blade 20 is held in position by liner lock 54. In the closed position (Figs.), contact pin 66 engages angled face 64 of bar spring 62 and forceably bends bar spring 62, which exerts a force on blade 20. As blade 20 moves between the open and closed position, contact pin 66 rotates into engagement with angled face 64 of bar spring 62 partially through its travel along arcuate slot 55. It should be noted that contact pin 66 moves through an "over center" point along its travel through arcuate slot 55, which is approximately the rearmost point of slot 55, where the bias force of bar spring 62 acts on the contact pin to either assist in opening blade 20 or holding it in the closed position. As blade 20 closes and contact pin 66 is rotated past the "over center " point toward the open end of arcuate slot 55, bar spring 62 exerts a "holding" force on blade 20, which holds the blade in the closed position. As blade 20 opens and contact pin 66 is rotated past the over center point towards the open end of arcuate slot 55, bar spring 62 exerts an "opening" force on blade 20, which biases the blade toward the open position. To initially open knife 10, blade 20 is manually rotated against the "holding" force of bar spring 62 until contact pin 66 rotates past the "over center" point where the bias force begins to assist the movement of the blade towards the open position. Similarly, to close knife 10, blade 20 must be manually rotated against the "opening" force of bar spring 62 until contact pin 66 rotates past the "over center" point where the bias of bar spring 62 again acts to hold the blade in the closed position.

Advantages

One skilled in the art will note several advantages of the assisted opening mechanism embodied in the folding knife of this invention. The assisted opening mechanism of this invention helps hold the blade in the closed position, as well as, assists in moving the blade toward the open position. The assisted opening mechanism of this invention can be readily incorporated into folding knives of any convention style, design or configuration, such as frame lock folders and liner lock folders. The folding knife and assisted opening mechanism can be easily disassembled for cleaning without special tools. The assisted opening mechanism does not affect the 'lock-up" of the blade in the open position or the closed position. The bar spring exerts no force on the blade when the blade is in the open position, but assists in holding the blade in the closed position until opening is manually initiated. The assisted opening mechanism adds two additional components, the bar spring and the contact pin on the blade, to the basic folding design. The bar spring is completely enclosed and protected within one side of the knife handle. The bar spring only engages the contact pin and causes no material wear on the blade itself.

The embodiment of the present invention herein described and illustrated is not intended to be exhaustive or to limit the invention to the precise form disclosed. It is presented to explain the invention so that others skilled in the art might utilize its teachings. The embodiment of the present invention may be modified within the scope of the following claims.

I claim:

1. A folding knife comprising:

a pair of handle sides;

a blade having a sharpened working end and a tang end pivotally connected between the pair of handle sides for rotational movement between an open position where the blade is extended from the pair of handle sides and a closed position where the blade is interposed between the pair of handle sides; and an assisted opening mechanism including an elongated bar spring mounted to one of the pair of handle sides and spaced parallel to the blade, and a contact pin extending from the tang of the blade configured to rotate with the blade movement from a first end position through a first intermediate range, a second intermediate range, a third intermediate range into a second end position such that the contact pin may rotate from the first end position through the first intermediate range without being biased by the elongated bar spring into engagement with the bar spring through the second intermediate range where the elongated bar spring engages the contact pin and biases the blade towards the first intermediate range, and the contact in may further rotate past an inflection point into the third intermediate range where the pin is biased towards the second end position, the contact pin forcibly engages the bar spring to hold the blade in the closed position and no other mechanism additionally holds the blade closed.

2. The folding knife of claim 1 wherein the one of the pair of handle sides includes a scale part having a recessed cavity defined therein and a liner part covering the recessed cavity.

3. The folding knife of claim 2 wherein the bar spring is disposed within the recessed cavity, the liner part having an arcuate slot defined therein in open communication with the cavity, the contact pin extending through the arcuate slot into the cavity.

4. The folding knife of claim 2 wherein the bar spring has a first end restrictively seated within a slot defined in the recessed cavity and a second end having an angled face.

5. The folding knife of claim 4 wherein the contact pin abuts the angled face when the blade is in the closed position.

6. A folding knife comprising:

a pair of handle sides, one of the pair of handle sides includes a scale part having a recessed cavity defined thereon and a liner part covering the recessed cavity, the liner part having an arcuate slot defined therin in open communication with the cavity;

a blade having a sharpened working end and a tang end pivotally connected between the pair of handle sides for rotational movement between an open position where the blade is extended from the pair of handle sides and a closed position where the blade is interposed between the pair of handle sides; and an assisted opening mechanism including an elongated bar spring disposed within the recessed cavity and spaced parallel to the blade, and a contact pin extending from tang of the the blade through the arcuate slot into the cavity, such that the contact pin is configured to rotate with the blade movement from a first end position through a first intermediate range, a second intermediate range, a third intermediate range into a second end position; such that the contact in may rotate from the first end position through the first intermediate range without being biased by the elongated bar spring into engagement with the bar spring through the second intermediate range where the elongated bar spring engages the contact in and biases the blade towards the first intermediate range, and the contact in may further rotate past an inflection point into the third intermediate range where the pin is biased towards the second end position where the elongated bar spring forcibly engages the bar spring to hold the blade in the closed position; the bar spring having a first end restrictively seated within a slot defined in the recessed cavity and a second end having an angled face, the contact pin abuts the angled face when the blade is in the closed position and no other mechanism additionally holds the blade closed.

7. A method of using a folding knife comprising:

providing a folding knife having a pair of handle sides;

providing a blade having a sharpened working end and a tang end with a contact pin extending from said tang end; and providing an assisted opening mechanism including an elongated bar spring having one end mounted fixedly between the pair of handle sides and an opposite end movable as a cantilever;

moving said blade from an operative open position to a closed position, said moving said blade causes said contact pin to move from a from a first end position through a first intermediate range, a second intermediate range, a third intermediate range, and into a second end position;

the contact pin is rotated from the first end position through the first intermediate range without being biased by the elongated bar spring the contact pin is then moved further to become engaged with the bar spring throughout the second intermediate range where the elongated bar spring engages the contact pin and biases the blade towards the first intermediate range; and moving the contact pin further to rotate past an inflection point into the third intermediate range where the pin is biased towards the second end position where the elongated bar spring forcibly engages the bar spring to hold the blade in the closed position without an additional mechanism to assist in holding.

* * * * *